US009004297B2

(12) United States Patent
Sjölander et al.

(10) Patent No.: US 9,004,297 B2
(45) Date of Patent: Apr. 14, 2015

(54) SHELF UNIT AND SHELVING SYSTEM

(75) Inventors: Håkan Sjölander, Bråcke (SE); John Andersen, Fredrikstad (NO)

(73) Assignee: Enjoy Group AB, Braecke (SE)

( * ) Notice: Subject to any disclaimer, the term of this patent is extended or adjusted under 35 U.S.C. 154(b) by 0 days.

(21) Appl. No.: 13/381,058

(22) PCT Filed: Oct. 13, 2011

(86) PCT No.: PCT/EP2011/067892

§ 371 (c)(1),
(2), (4) Date: Feb. 27, 2012

(87) PCT Pub. No.: WO2012/049249

PCT Pub. Date: Apr. 19, 2012

(65) Prior Publication Data

US 2012/0193312 A1 Aug. 2, 2012

(30) Foreign Application Priority Data

Oct. 14, 2010 (EP) ..... 10187542

(51) Int. Cl.

| | |
|---|---|
| ***A47F 1/04*** | (2006.01) |
| ***A47F 5/02*** | (2006.01) |
| ***A47F 1/12*** | (2006.01) |

(52) U.S. Cl.

CPC ..... *A47F 1/12* (2013.01)

(58) Field of Classification Search

CPC .... A47B 49/00; A47B 49/004; A47B 49/006; A47F 1/12; A47F 3/06; A47F 3/10; A47F 5/02; A47F 5/03

USPC ..... 211/59.2, 103, 193, 90.01, 90.02, 150, 211/78, 70, 163, 144; 108/9, 95, 94, 96, 108/139; 312/125, 135, 136, 305; 248/240, 248/242, 250, 285.1

See application file for complete search history.

(56) References Cited

U.S. PATENT DOCUMENTS

| | | | | | |
|---|---|---|---|---|---|
| 1,165,144 | A | * | 12/1915 | Tillotson | 108/7 |
| 1,375,225 | A | * | 4/1921 | Marshall | 248/242 |
| 2,647,812 | A | * | 8/1953 | Saunders | 312/294 |
| 2,845,990 | A | * | 8/1958 | Hubert | 297/461 |
| 3,954,244 | A | * | 5/1976 | Gopstein | 248/349.1 |
| 5,277,486 | A | * | 1/1994 | Bustos | 312/125 |
| 5,518,245 | A | * | 5/1996 | Nelson | 473/279 |
| 5,832,840 | A | * | 11/1998 | Woof | 108/6 |
| 5,839,373 | A | * | 11/1998 | Lin | 108/140 |
| 6,161,806 | A | * | 12/2000 | Crosson | 248/118.3 |
| 6,843,382 | B2 | * | 1/2005 | Kanouchi et al. | 211/90.02 |
| 7,758,444 | B2 | * | 7/2010 | Crossley | 473/279 |

FOREIGN PATENT DOCUMENTS

| | | | |
|---|---|---|---|
| RU | 18339 | U1 | 6/2001 |
| WO | WO-0160216 | A1 | 8/2001 |
| WO | WO-2008060222 | A1 | 5/2008 |
| WO | WO-2010143973 | A1 | 12/2010 |

* cited by examiner

*Primary Examiner* — Joshua Rodden

(74) *Attorney, Agent, or Firm* — Harness, Dickey & Pierce, P.L.C.

(57) ABSTRACT

Example embodiments relate to a rotatable gravity feeding shelf unit having a bracket onto which a rotatable shelf is arranged. The shelf is arranged having an inclination angle for providing gravity feeding in a forward direction in a display position when a front side of the shelf is accessible. The shelf unit further includes a tilting device arranged for providing tilting of the plane of rotation of the shelf during rotation, thereby controlling the inclination angle of the shelf.

19 Claims, 9 Drawing Sheets

SHELF UNIT AND SHELVING SYSTEM

FIELD OF THE INVENTION

Example embodiments relate generally to a shelf unit, more specifically to a rotatable gravity feeding shelf unit comprising a shelf arranged on a bracket, which shelf, in a display position when a front side of the shelf is accessible, is arranged having an inclination angle for providing gravity feeding in a forward direction.

BACKGROUND

Gravity feeding rotatable shelving systems for the purpose of exposing products and articles to customers in stores are known. By providing gravity feeding new articles are transported to the front side of the shelves as a customer purchases an article. To avoid that articles with a certain best-before date, do not get hidden from the customer by means of articles, having better best-before dates, being placed in front of the older articles when refilling the shelf, the gravity feeding shelves are preferably refilled from the rear.

WO 2008/060222 discloses a shelf assembly for displaying articles, which shelf assembly is to be placed in a limited space. The shelf assembly consists of a shelving section with a front and a rear having a plurality of gravity-feeding shelving sections vertically arranged. The shelving section is arranged to be rotatable about an axis of rotation, between a display position in which the front of the shelving sections is accessible, and a refill position in which the rear of the shelving section is accessible.

Although, the shelving assembly above is generally good for providing an efficient refilling of the shelving assembly from the rear, it is limited when it comes to flexibility of refilling. For instance if one article which is displayed on one shelf is more popular than the articles on the other shelves, the whole assembly must be rotated when refilling that specific shelf, which exposes the staff for unnecessary work.

SUMMARY

An object of example embodiments is to provide an improved solution for shelves, which can be refilled from behind without suffering from drawbacks indicated in connection with prior art.

More specifically, according to one aspect of example embodiments there is provided a rotatable gravity feeding shelf unit comprising a bracket and a shelf. The shelf, in a display position when a front side of the shelf is accessible, is arranged having an inclination angle for providing gravity feeding in a forward direction. The shelf is rotatably engaged with the bracket. The shelf unit further comprises tilting means arranged for providing tilting of the plane of rotation of the shelf during rotation, thereby controlling the inclination angle of the shelf.

With the present inventive concept a free standing shelf unit is provided which is mountable to a wall or other support structure in a store or warehouse. The shelf unit provides built in functionalities of gravity feeding, providing rotatability of the shelf, and providing control of the inclination angle of the shelf, which is advantageous. Several shelf units may be mounted adjacently (vertically and/or laterally) to provide a shelving system, in which each shelf is individually controlled. Regardless if most of the shelves in the shelving system are not in the need of refilling, when one individual shelf needs to be refilled, that particular shelf is rotated to a refill position. This is advantageous as this is less heavy, and less complicated for the staff as compared to rotating a complete shelving system.

As shelf units according to example embodiments provide individual mounting of shelves in a shelving system, each shelf unit may be individually positioned, vertically, horizontally, and in depth. This is advantageous in that it for instance enables that the floor shelf unit (the shelf unit which is arranged closest to the floor), which may have a poor exposure to the customer, can be positioned with an offset in depth with respect to other shelf units, such that the that floor shelf unit becomes more exposed to the customer.

A further advantage with the shelf unit is that it in addition to providing a simpler, less heavy mounting procedure, which may be done without special tools and by the staff in the store, transport and logistics is simplified as handling of a shelf unit is less heavy, and less complicated than for a prior art rotatable shelving system.

By tilting the plane of rotation of the shelf, the inclination angle is advantageously controlled and may be selected, for instance to be suitable for the refilling of the shelf with a merchandise of a specific weight or bottom side surface friction. When filling the shelf from the rear side of the shelf, which is commonly done with gravity feeding shelves, a too steep inclination of the shelf may result in articles gaining to high speed when sliding towards the front of the shelf, after which they may tip over the front edge.

Further, as the example embodiments concept allows for control of the inclination angle of the shelf, a sloping floor or irregularities in the floor may be compensated for. When mounting the shelf unit in a support structure arranged on the sloping floor, a desired inclination of the shelf can be achieved by slightly rotating the shelf.

According to an example embodiment of the shelf unit, a direction and an amplitude of the tilting during rotation of the shelf between the display position and a refill position, when the shelf is accessible from a rear side, is selected to provide a predetermined inclination angle of the shelf in the refill position. This is advantageous for instance when the tilting of the plane of rotation of the shelf is selected to be in a direction providing a decreased inclination angle of the shelf during rotation from the display position to the refill position, the rear edge of the shelf, which in the display position is positioned vertically higher than the front edge of the shelf for providing gravity feeding, will be lowered. If the shelf is positioned in a vertically limited space, and particularly when being vertically positioned between other shelves having an inclination angle for providing gravity feeding, the total vertical space needed for rotating the shelf will advantageously be decreased. Thus, the vertical packing density of adjacently arranged shelf units in a shelving system may be increased, such that an increased number of shelf units fit into a limited space.

According to an example embodiment of the shelf unit, the predetermined inclination angle in the refill position is zero, thereby providing levelling of the shelf, which is advantageous for refilling of e.g. delicate articles which need to be carefully handled, like glass bottles, or tall, thin articles that easily tilt over.

According to an example embodiment of the shelf unit, the inclination angle in the display position is at least partly provided by the tilting means. That is, the tilting means may be arranged such that the shelf is provided with an initial (at the display position present) inclination angle, which is advantageous, since then the shelf itself can be of a relatively simple design which facilitates replacing of the shelf etc.

According to an example embodiment of the shelf unit, the tilting means is arranged on the bracket, and is a rotatable inclined bracket element having a predetermined bracket angle, onto which the inclined bracket element of the shelf is arranged. The tilting of the plane of rotation is determined by the bracket angle. The bracket angle may be a fixed angle which is determined by the design of the bracket, or may be adjustable.

According to an example embodiment of the shelf unit, the tilting means is arranged as a rail whose vertical profile comprises a height difference along the extension of the rail, and a corresponding tracking means arranged for running along the rail. The rail is arranged on the shelf, and the corresponding tracking means is arranged on the bracket, or vice versa. That is, the tracking means may be arranged on the shelf and the rail is arranged on the bracket. This embodiment is advantageous because with the rail, the tilting of the shelf, and thereby the inclination angle of the shelf, can be carefully controlled during the rotation of the shelf.

According to an example embodiment of the shelf unit, the tracking means is one of a receiving recess, and at least one roller element, which provide advantageous solutions with respect to manufacturing and cost.

According to an example embodiment of the shelf unit, the trail runs along at least part of a circular path, which facilitates the rotation of the shelf.

According to an example embodiment of the shelf unit, the height difference of the trail is one of a proportional to the rotation of the shelf, and stepwise during the rotation of the shelf. That is, the control of the inclination angle of the shelf is advantageously controllable in different ways. In some situations, the proportional decrease or increase in inclination angle is applicable, while in other situations, depending on the limitation of space for the rotation of the shelf, a stepwise increase or decrease of the inclination angle is applicable. The solution according to the present inventive concept thus provides a high flexibility.

According to an example embodiment of the shelf unit, at least a portion of the bracket is arranged to tilt during the rotation of the shelf. That is, part of the change in inclination of the shelf comes from tilting the bracket which is advantageous.

According to an example embodiment of the shelf unit, the bracket is further arranged for mounting into an existing shelving system, which is highly advantageous. The flexibility of the shelf unit derives from the shelf unit in itself being a freestanding unit. That is it can easily be integrated in an existing shelving system, the bracket provides the fixation to the existing shelving system, but also in itself governs the functionality of the shelf.

According to an example embodiment of the shelf unit, the shelf is arranged to rotate about an asymmetrically positioned axis of rotation, which is positioned closer to the front edge of the shelf than to the rear side of the shelf, which facilitates using the shelf unit in a limited space.

According to an example embodiment of the shelf unit, the shelf unit further comprises means for interconnecting the shelf unit with at least one adjacently positioned shelf unit. Thereby, a number of shelf units may be rotated simultaneously, which is advantageous when refilling of a whole section of shelves is needed, e.g. when several shelf units display the same article.

According to another example embodiment, there is provided a shelving system comprising a plurality of adjacently positioned shelf units according to the invention, providing the benefits as described above when discussing the shelf unit. The shelf units may be interconnected.

BRIEF DESCRIPTION OF THE DRAWINGS

The invention will now be described in more detail by way of non-limiting embodiments and with reference to the accompanying drawings. Equivalent components in the example embodiments have the same reference numerals.

DESCRIPTION OF EXAMPLE EMBODIMENTS

Figure 1A:
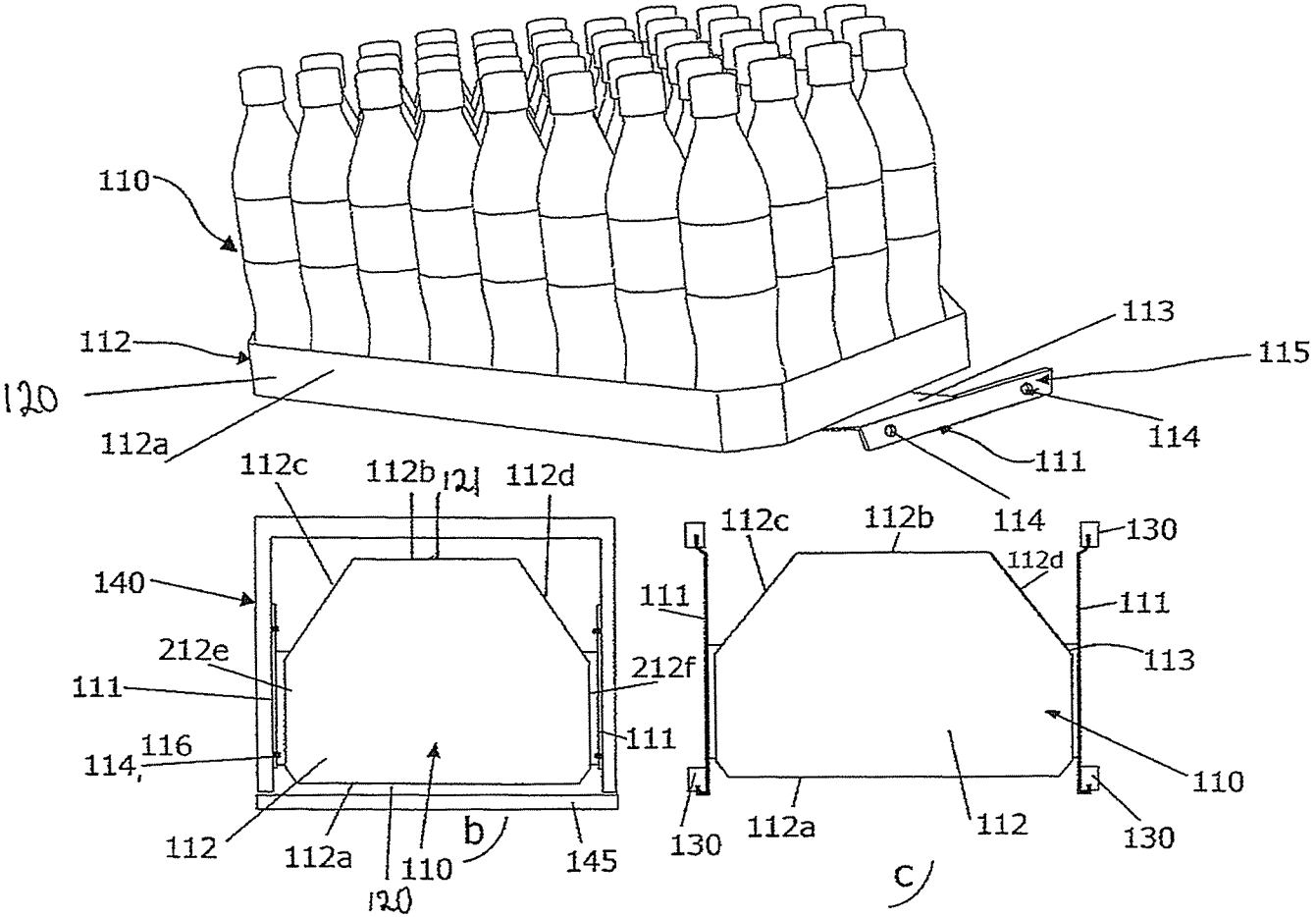
FIG. 1*a* is a perspective front-side view and 1*b*-1*c* are two top views illustrating embodiments of a shelf unit according to an example embodiment.

According to an example embodiment of a shelf unit 110, described with reference to FIGS. 1*a*-1*c* the shelf unit 110 comprises a substantially rectangular shelf 112 having trimmed rear corners 112*c,d* (here being cut out). Trimmed may further refer to rounded, arcurate, or bevelled corners so as to assist the rotatability of the shelf unit when mounted in a limited space which is illustrated in FIGS. 1*b* and 1*c*. However, other suitable shapes of the design of the shelf are applicable for the concept. The shelf 112 may be manufactured in a metal or other suitable material, and may for instance be moulded from a hard-wearing plastic material. The front edge 112*a*, rear edge 112*b* and side edges 112*c*-*f* of the shelf 112 are arranged with supporting upturned flanges to support articles, here bottles, being displayed on the shelf such that they do not fall over the edges of the shelf 112. The shelf may further be arranged with tracks for separating different variants of an article (not shown).

The shelf 112 is arranged having an inclination angle $\alpha$, see FIG. 2*a*, such that gravity feeding of articles placed on the shelf 112 is assisted. In a display position the front edge 112*a* is thus positioned such that the customer can access the shelf unit 110 from the front side 120 of the shelf 112. When a person removes articles to be purchased, a vacancy occurs along the front edge 112*a* of the shelf. This vacancy is then filled with the article which was previously closest to the removed article, and which automatically slides on the gravity shelf 112 towards the front edge 112*a*. To facilitate the gravity feeding the surface friction of upper surface of the shelf 112 may be decreased e.g. by applying varnish or any other low friction material on the upper surface of the shelf 112. Exchangeable sliding tracks may employed.

The shelf unit 110 further comprises a bracket 115 onto which the shelf 112 is rotatably arranged to rotate about an axis of rotation. In this exemplifying embodiment the bracket 115 comprises a substantially horizontally arranged rectangular support plate 113. The support plate 113 is along its two side edges engaged with a respective elongated bracket member 111, each of which is arranged with mounting means, here apertures 114 arranged for receiving a screw or bolt for mounting of the bracket 115 to a support structure, like a wall or a shelf chassis.

FIG. 1 *b*) is a top view of the shelf unit 110 being arranged inside a cabinet 140 having a front door 145, to which front door 145 the front side 120 of the shelf unit 110 is facing when the shelf unit 110 is arranged in the display position. The cabinet 140 may be a refrigerator, arranged with a front door 145 or a refrigerator without a front door.

FIG. 1*c*) is a top view of the shelf unit 110 being mounted to a shelving structure comprising four corner posts 130 onto which the bracket members 111 are mounted. The shelving structure may be an existing shelving structure employing other types of shelves as well, or a shelving structure specifically arranged for employing shelf units according to the present inventive concept. The arrangement of the bracket members 111 and their mounting means 114 is preferably adapted for a specific mounting place, i.e. suitable for the cabinet or other mounting structure of choice.

Figure 2:
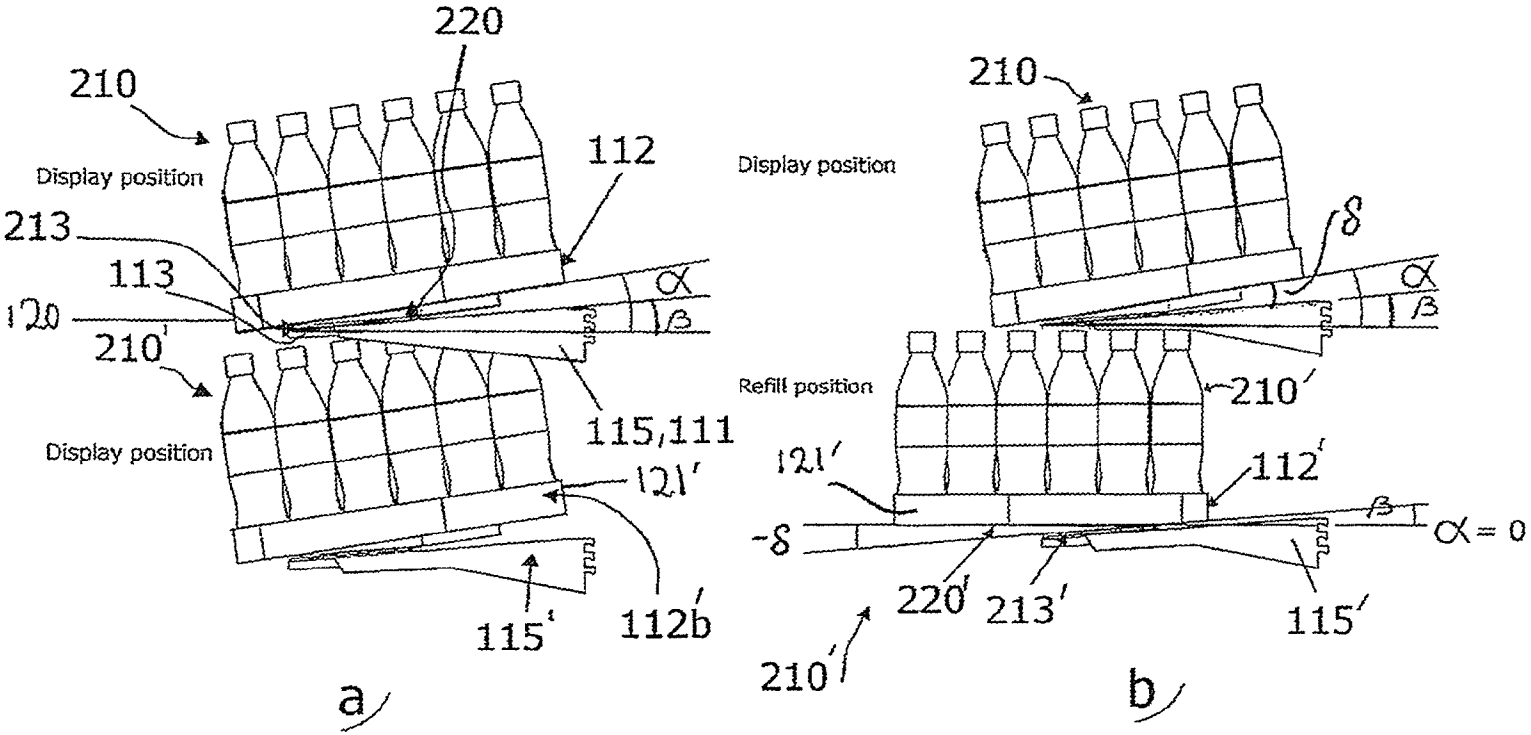
FIGS. 2*a*-2*b* show perspective side views of two vertically mounted shelf units according to an example embodiment when both shelf units are in display position, and one shelf unit is in a refill position and one shelf unit is in display position, respectively, and 2*c* shows a side view of an embodiment of a shelf unit according to an example embodiment.
Figure 2C:
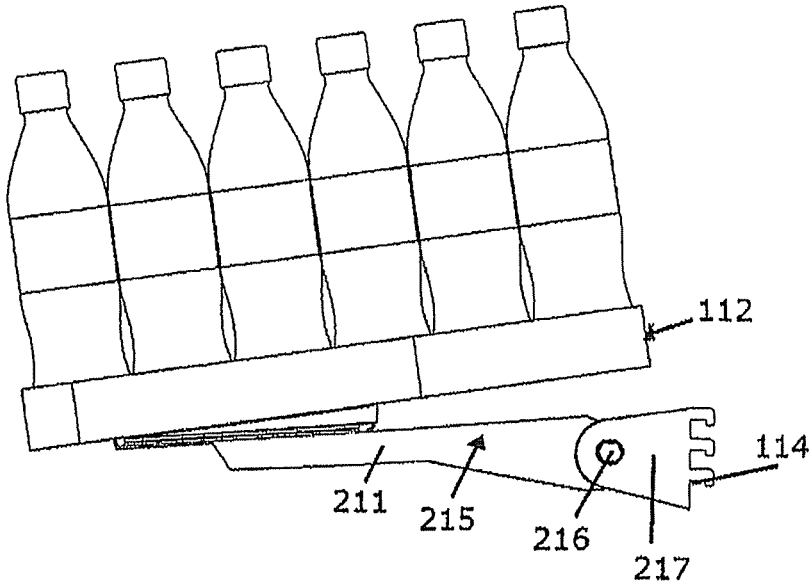

To continue, in this embodiment the support plate 113 is arranged having a bracket angle β, which angle is illustrated in FIG. 2. The bracket angle β may be arranged by providing an inclination of the upper rim of the bracket members 111, or by mounting the bracket members 111 with a predetermined angle of inclination. The bracket angle β may be selected to be fixed or adjustable, e.g. by utilizing adjustable mounting means 217, 114 as is illustrated in FIG. 2*c*. The shelf unit is arranged with a bracket 215 comprising an elongated bracket member 211, which has a rear end 217 pivotally arranged about a bolted joint 216. In this case a desired bracket angle may be selected by adjusting the angle of the elongated bracket members 211 and then fixating the selected bracket angle β by means of tightening the bolted joint 216.

As is evidently understood by a man skilled in the art, the bracket members and the mounting means may be designed in numerous forms of execution to fit the specific environment in which the shelf unit is to be mounted, or to meet other requirements like e.g. weight of the shelf when filled, space limitations, existing shelving structures etc. Further, the bracket angle may be provided in other ways, e.g. by a wedge shaped element arranged on the support plate.

Figure 3:
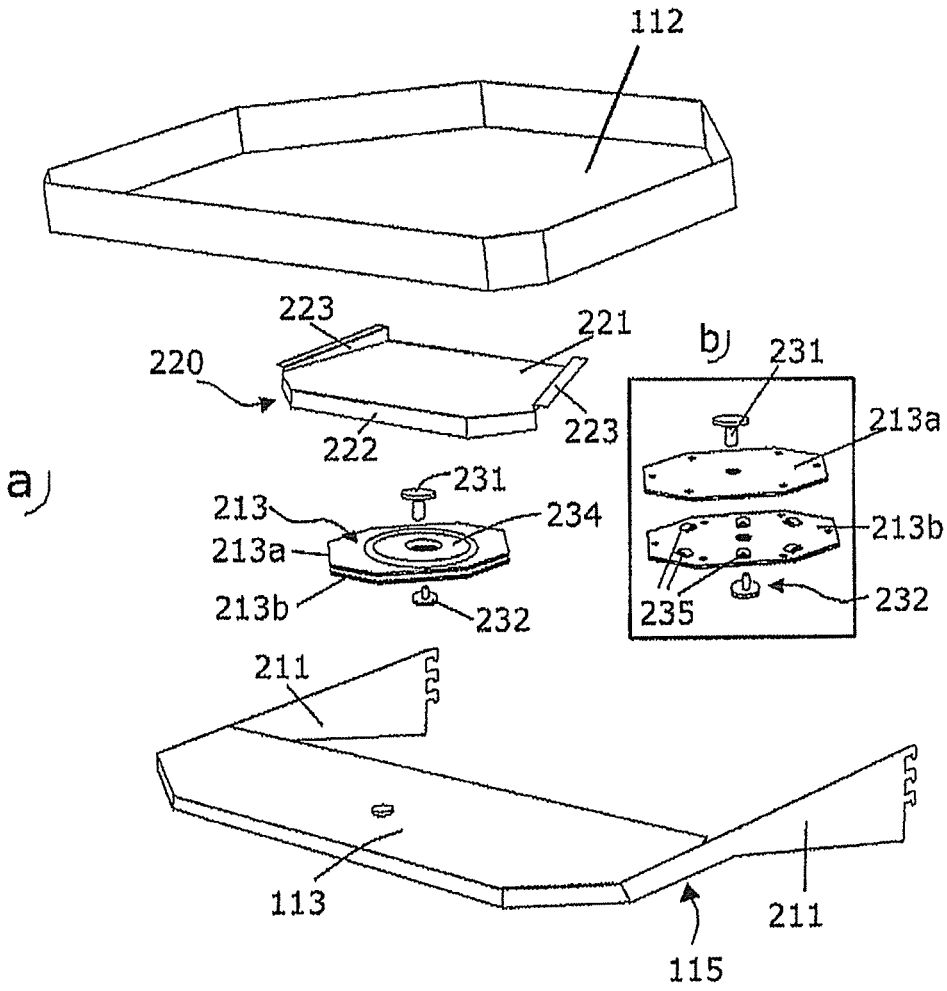
FIG. 3*a* is an exploded perspective view of, and 3*b* shows a detail of embodiments of a shelf unit according to an example embodiment.

In an embodiment of a shelf unit as described with reference to FIGS. 2 and 3, the shelf unit 210 comprises a shelf 112 rotatably arranged on a bracket 115, which here comprises a support plate 113 which is engaged with two elongated support members 211. At the upper surface of the support plate 113 a rotatable disc 213 is arranged. Here, the rotatable disc 213 is a ball bearing turning disc. A ball bearing turning disc is typically two sandwiched discs 213*a*, 213*b* which are rotatably connected with a ball bearing at their centres. Alternatively, the discs may be rotatably arranged with a gear shaft. The lower disc 213*b* is fixated to the support plate 113. The upper disc 213*a* is fixated to the shelf 112, while having a wedge shaped member 220 inserted between the shelf 112 and the upper disc 213*a*. A respective shaft alley and shaft 231, 232 are used to fixate the ball bearing turning disc 213 while providing stabilization of the construction.

Alternatively the rotatable disc is arranged as illustrated in FIG. 3*b*, in which the two sandwiched discs, 213*a* and 213*b*, are rotatably arranged to rotate about the shaft alley and shaft 231, 232 while being supported by wheels 235 arranged in a substantially circular arrangement on the lower disc 213*b*, on which wheels 235 the upper disc 213*a* rotates.

To continue with reference to FIG. 3*a*, the wedge shaped member 220, which here is a metal plate 221 with inclining outer flange bars 223, defines a predetermined inclination δ, see FIG. 2*b*, which together with the bracket angle β, contributes to the inclination angle α of the shelf unit in the display position and thus to the gravity feeding of the shelf unit 210 in the display position.

FIG. 2*a*, is a perspective side view of two shelf units 210, 210' being vertically mounted, i.e. above each other, and being in the display position. It is desirable to pack the articles as close as possible to utilize the space inside e.g. a refrigerator as efficiently as possible, thus a high packing density (both vertically and adjacently, as will be illustrated later) is important. It can be seen in FIG. 2*a*, that a rotation of the shelf 112' of lower shelf unit 210' in a horizontal plane, like in prior art solutions, is not possible due to the height of the bottles and the high position of the rear side 121' of the inclining shelf 112' vs. the low position of the front side 120 of the upper shelf unit 210, causing the top end of a bottle located at the rear side 121' of the lower shelf 112' to be positioned above the level of the lowest portion of the front side 120 of the upper shelf unit 210. In FIG. 2*b*) the lower shelf unit 210' is in a refill position, that is, the shelf 112' has been turned such that the rear side 121' of the shelf 112' is accessible, thereby allowing the shelf to be refilled with fresh bottles from the rear side 121'. In this example the wedge shaped member 220 is arranged having an inclination angle δ 4.25°, and the bracket angle 13 is set to 4.25°, such that in the display position as seen for the upper shelf unit 210, the inclination angle of the shelf a is 8.5°, which is applicable for a number of articles, e.g. soda bottles. The lower shelf 112' needs to be refilled, and has been turned around such that the rear edge 112*b'* of the shelf 112' faces the user. The rotation of the shelf 112' is supported by the rotatable disc 213' having the bracket angle β 4.25°. Thus when the wedge shaped member 220' is rotated together with the shelf 112' substantially 180°, the plane of the rotation of the shelf 112' tilts −4.25° with respect to the bracket angle β 4.25°. Thereby, the shelf levels such that in the refill position, the inclination angle of the shelf is 0°. By arranging the shelf unit selecting other predetermined values of the bracket angle β and the wedge angle δ other desired inclination angles of the shelf in the refill position (or an intermediate position if desirable) are achievable.

Figure 4:
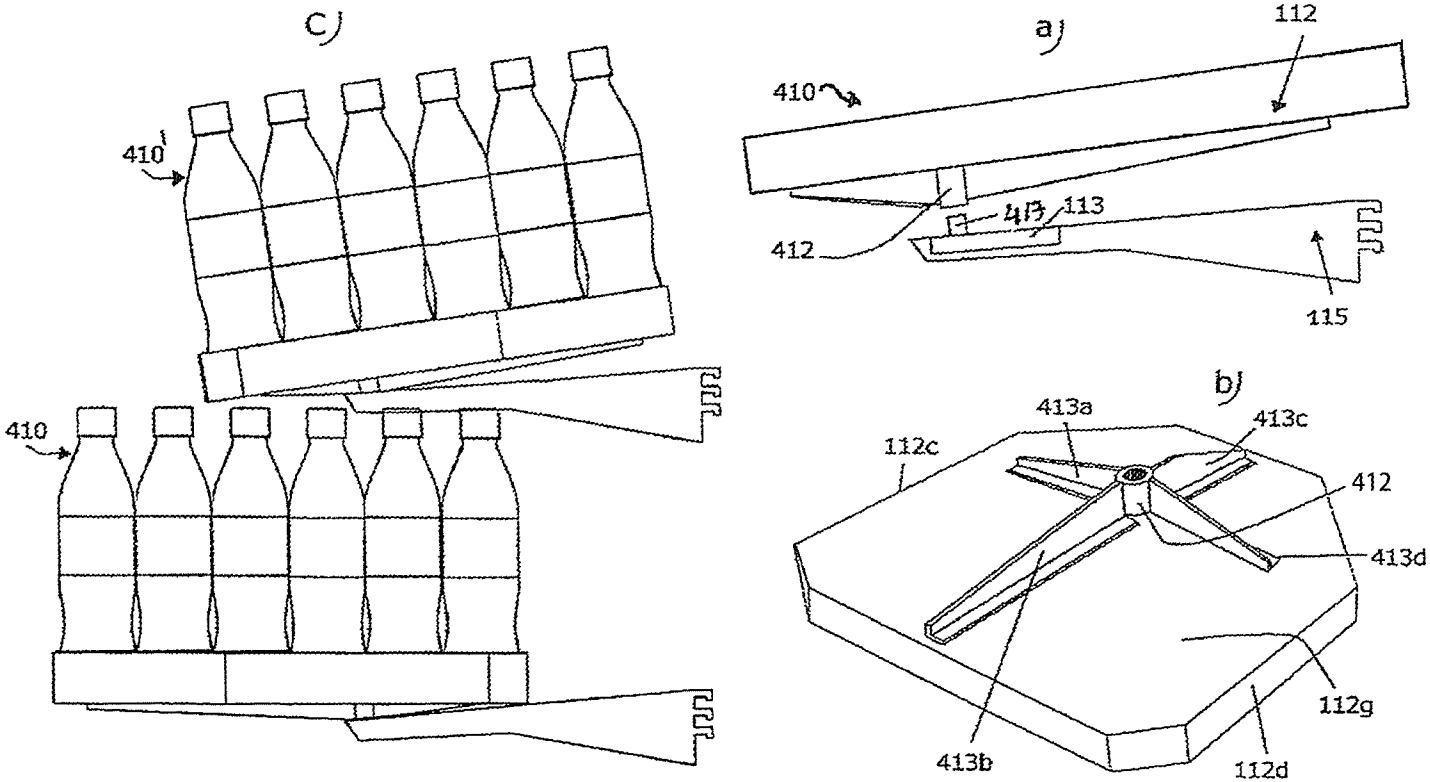
FIG. 4*a* is a partly exploded side view of an embodiment of a shelf unit according to an example embodiment.
FIG. 4*b* shows part of the shelf unit in FIG. 4*a* in detail.
FIG. 4*c* is a perspective side view of two vertically mounted display units as illustrated in FIG. 4*a* when one shelf unit is in a refill position and one shelf unit is in display position.

FIG. 4*a* is a partly exploded side view to illustrate an embodiment of a shelf unit 410 with substantially the same construction as for the embodiments as described with reference to FIG. 2, i.e. the shelf unit 410 comprises of a shelf 112, having a predetermined inclination angle α, as defined in FIG. 2, in the display position for facilitating gravity feeding. The shelf is rotatably arranged on a bracket 115 comprising a support plate 113 which is arranged with a bracket angle (3. A shaft alley 412 is mounted extending in a normal direction from the lower surface 112*g* of the shelf 112. In mounted position, the shaft alley 412 is connected to a shaft 417 arranged extending in a normal direction from the upper surface of the support plate 113. With reference to FIG. 4*b*, the shaft 417 is arranged with four support elements 413*a-d* for reinforcement of the shelf 112. Two support elements, 413*b*, 413*c*, extend in opposite directions from the shaft alley 412 in parallel with the side edges 112*c*, 112*d* of the shelf, and two support elements, 413*a*, 413*d*, extend in opposite directions from the shaft alley 412 and perpendicularly with respect to the sides 112*c*, 112*d* of the shelf. FIG. 4*c*) illustrate the shelf unit 410 in FIG. 4*a* when arranged vertically adjacent to another shelf unit 410'.

In an embodiment of the shelf unit 500, as illustrated in FIG. 5, a shelf 512 is rotatably arranged on a bracket 515. The bracket 515 has an elongated rectangular support plate 513. Each side edge of the support plate 513, is at its centre pivotally engaged, at a front end 511*a*, with an elongated bracket member 511. Each bracket member 511 is at a rear end provided with mounting means 514 for mounting to a support structure, like a wall or a shelf chassis.

As explained above, the support plate 513 is thus tiltable about the pivotal connections 516 on the elongated bracket members 511. On an upper surface of the tiltable support plate 513, a rotatable disc 213 according to the description above is fixated. Further, the shelf 512 is arranged on top of the rotatable disc 213.

Figure 5A:
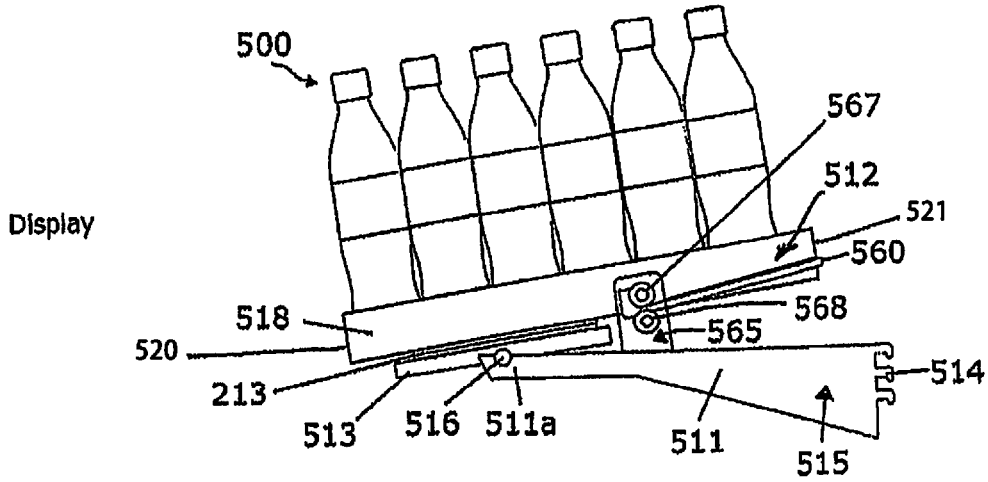
FIGS. 5*a* and 5*b* show side views of an example embodiment of a shelf unit according to an example embodiment in a display position and a refill position.
Figure 5B:
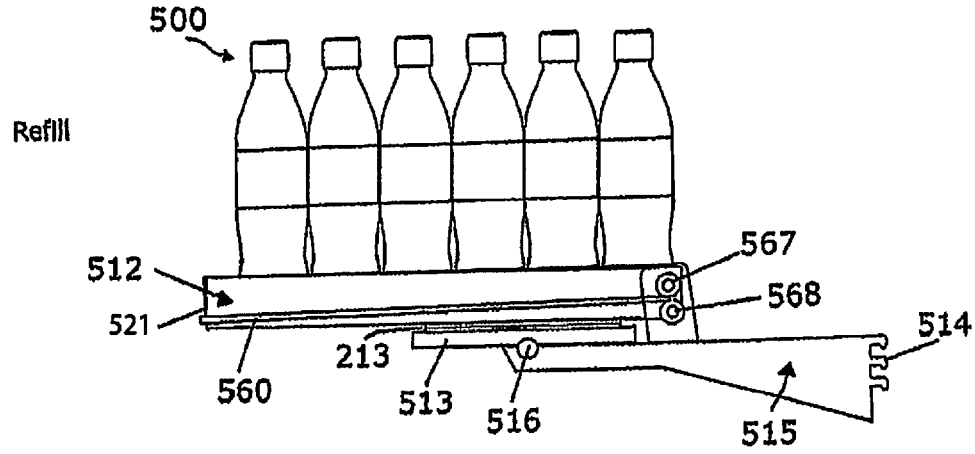
Figure 5D:
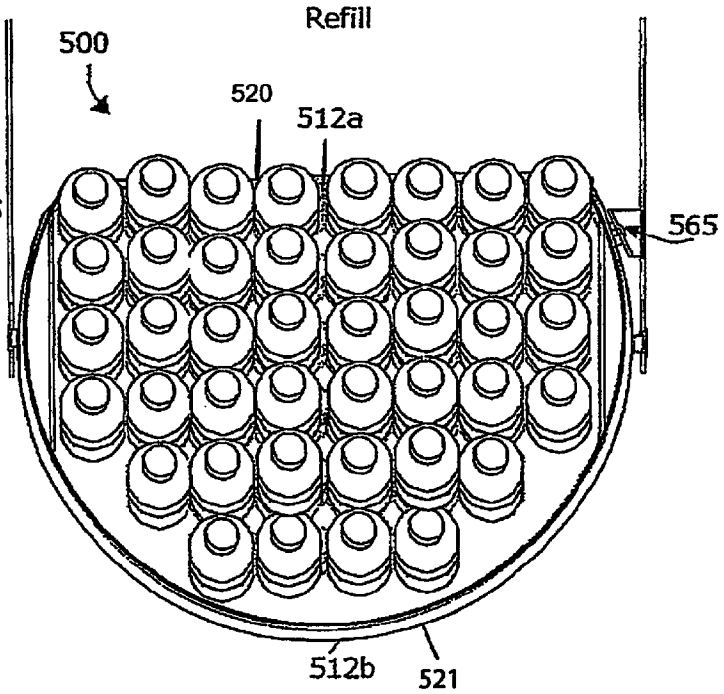
FIGS. 5*c* and 5*d* show top views of the embodiment of FIGS. 5*a* and 5*b* in a display position and a refill position.
Figure 5C:
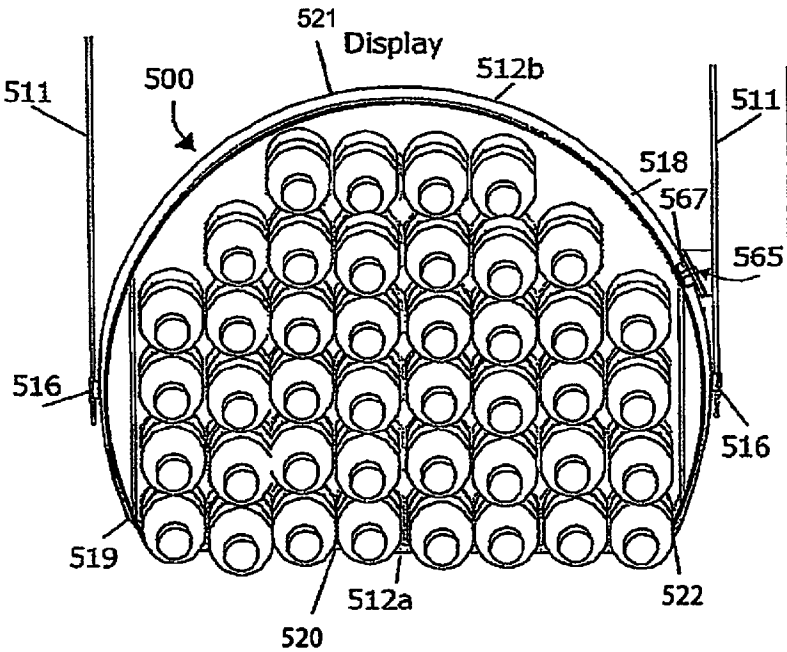

As illustrated in top views of the shelf unit 500 in FIGS. 5*c* and 5*d*, the shape of the shelf 512 is that of a truncated circular plate, where the straight edge 512*a* forms a front edge of the shelf 512. The front edge 512*a* is in the display position arranged in a forward direction, facing the customer, such that the shelf 512 is accessible from the front side 520. The shelf 512 is arranged to rotate about an axis of rotation which is positioned at the centre of a geometric circle whose diameter corresponds to the circular shape of the shelf 512. However, due to the cut off straight front edge 512*a*, the distance from the axis of rotation and the front edge 512*a*, is less than the distance from the axis of rotation to the rear side 521 of the shelf 512, that is at the edge oppositely arranged to the front side 520. The shape of the shelf and position of the axis of rotation facilitates rotating the shelf in a limited space. The shelf 512 may be manufactured in a metal or other suitable material, like a hard-wearing plastic material. The front edge 512*a* and side edges of the shelf are arranged with a supporting upturned flange 518 to support articles to be displayed on the shelf such that they do not fall over the edges of the shelf.

In alternative embodiments of a shelf unit according to the present inventive concept, instead of, or in addition to, the flange, the shelf is provided with a net basket or a suitable box to display articles which are displayed in bulk, like for instance fruit.

To continue, now with reference to FIGS. 5*a* and 5*c*, a rail 560 is arranged along an outer side of the flange 518. The rail 560 is arranged having a height difference along its extension, such that when starting from a first corner 519 at the front edge 512*a*, the rail has a first height, but when moving around the circular outer rim of the shelf 512, the rail 560 is arranged to be vertically displaced proportionally to the position along the circular outer rim of the flange 518. The rail 560 here has a fixed vertical height/thickness, but the rail 560 is bent such that the vertical position of the rail is higher at the second corner 522 of the front edge 512*a* as compared to the vertical position at the first corner 519 of the front edge 512*a*.

In an alternative embodiment the height difference of the vertical position of the rail is provided as (a smooth) vertical step provided near the second corner of the front side (not shown). In an alternative embodiment the height difference of the vertical position of the rail is adapted to the specific shelf and may be varied for instance in several steps around the circular flange (not shown).

To continue with the embodiment as described with reference to FIG. 5, the bracket 515 further comprises a tracking means 565 for tracking the rail 560 of the shelf 512. The tracking means 565 is here a support body arranged on one of the elongated bracket members 511, onto which two roller elements 567, 568, i.e. two wheels adapted to be movably engaged with opposite sides of the rail 560, are arranged having a vertical separation into which the rail 560 is fitted. The separation of the two wheels 567, 568 may be fixed or guided by a spring such that each wheel presses onto its respective side of the rail 560, thereby controlling the position of the shelf. When, the shelf 512 is rotated, the wheels 567, 568 track the rail 560, and follow the height difference of the rail 560. Since the position in height of the wheels 567,568 is substantially fixed, this in turn forces the shelf 512 to tilt, such that the inclination angle of the shelf 512 changes. The tilting of the shelf 512 is facilitated by the pivotally arranged support plate 513. FIGS. 5*a* and 5*c* show the shelf unit 500 in a display position and FIGS. 5*b* and 5*d* in a refill position.

In an alternative embodiment, the rail is arranged such that the height of the vertical profile is changed proportionally with respect to the extension of the rail. Preferably the trail has a semicircular extension, such that tracking of the rail during rotation of the shelf is facilitated. Further, provided that the tracking means is a protrusion arranged on the bracket such that is engages with the rail, the rail can be arranged as a recess extending along the outer rim of the shelf (not shown).

In an alternative embodiment, the rail can be formed by the edge of the shelf, or the flange of the shelf. In an embodiment when the edge of the shelf is used as rail, the height of the edge is increased during 60 degrees of a total 180 degrees rotation. That is, when rotating the shelf the first 120 degrees, no tilt of the plane of rotation of the shelf is provided, but the last 60 degrees as the shelf is rotated into refill position, the shelf tilts in correspondence with a height difference provided vertical position of the rail, i.e. the edge or flange.

Figure 6:
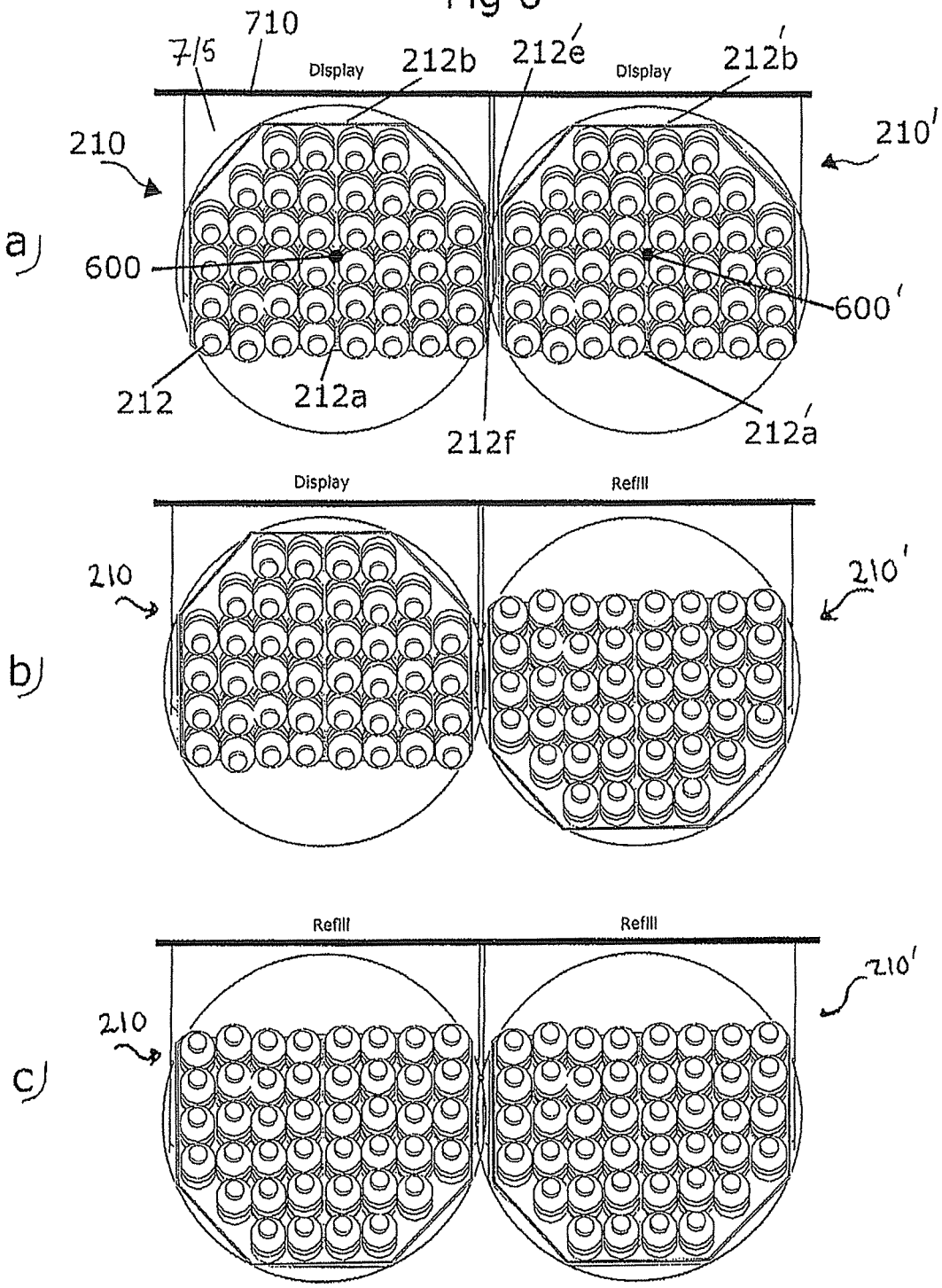
FIGS. 6*a*-*c* illustrate laterally arranged embodiments of a shelf unit according to an example embodiment.

In FIG. 6, top views of a situation in which two shelf units 210, 210' are separately, but adjacently mounted. The lateral separation between the two shelf units is preferably selected as small as possible, but with a preserved functionality of the rotatable shelf units 210, 210'. To facilitate the rotation of the shelf in a limited space 715, the shelf 212 is rotatable about an axis of rotation 600 between the display position and a refill position, which axis of rotation is asymmetrically located in relation to the centre of the shelf. More particularly the axis of rotation is positioned closer to the front edge 212*a* of the shelf 212 than to the rear side 212*b* of the shelf 212. The axis of rotation 600 coincides with the centre of a geometric circle whose diameter corresponds to the width of the space and is tangent to the lateral surfaces 710 of the rear boundary surface of the limited space 715. The shelf 212 is as previously described, substantially rectangular with trimmed rear corners. The corresponding arrangement applies to the shelf unit 210'. As is illustrated by the geometric circles in FIGS. 6*a*-6*c*, the shape and dimension of the shelves 212, 212' facilitate the rotation of adjacently arranged shelf units. That is, when rotating the shelf 212' of the shelf unit 210' from the display position to the refill position as illustrated in FIG. 6*b*, the trace of the shelf 212' outer rim (illustrated by the geometric circle) tangents the right edge 212*f* of the shelf unit 212, and vice versa. When rotating the shelf 212 of shelf unit 210 from the display position to the refill position as illustrated in FIG. 6*c*, the trace of the shelf 212 outer rim (illustrated by the geometric circle) tangents the left edge 212*e'* of the shelf 212'.

Figure 7:
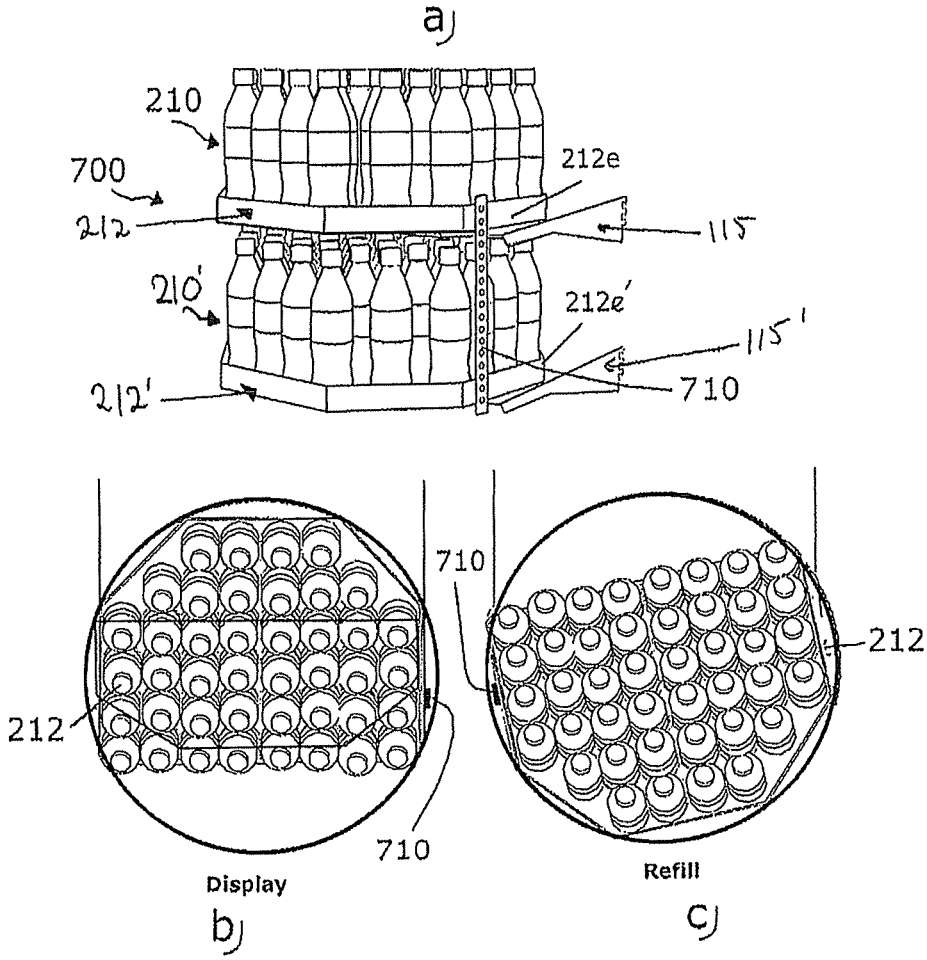
FIGS. 7*a*-7*c* are illustrations of an embodiment of a shelving system according to an example embodiment.

FIG. 7 is an illustration of a shelving system 700 comprising two shelf units 210, 210' arranged on e.g. a wall. The shelf units 210, 210' are interconnected by means of a handle 710, here being a vertically extending punched metal rod which is fixed to the left sides 212*e*, 212*e'* of the shelves 212, 212' by means of e.g. screws. Thereby, a user can simultaneously rotate both shelves 212, 212' with respect to their respective brackets 115, 115'. FIGS. 7*b* and 7*c* illustrate the display position and the refill position of shelf system 700 where it can be noticed that the refill position in this particular example is not at a full 180° degrees, due to the position of the handle 710, which is arranged to facilitate access to the handle for the user.

Shelf units according to the present inventive concept are applicable for different kinds of shelving systems: open shelving systems, and shelving systems arranged in a limited space, e.g. a refrigerator with doors. The limited space may also consist of a cabinet without doors, or of walls, support structures, or consist of other juxtaposed and/or posteriorly situated shelf assemblies. Also other combinations of shelf assemblies, cabinets and walls constitute conceivable limited spaces, which are not to be excluded by the description.

The invention claimed is:

1. A shelf assembly for displaying products including a plurality of vertically arranged gravity feeding shelf units, each of said shelf units comprising:

a bracket;

a shelf configured to support a plurality of products to be displayed having a front side and an opposite rear side, wherein said shelf, in a display position facing a forward direction when products placed on said shelf are accessible via said front side of said shelf, is arranged having an inclination angle for providing gravity feeding of said products in said forward direction, and wherein said shelf is rotatably engaged with said bracket to be rotatable about an axis of rotation between said display position and a refill position of said shelf when said rear side is facing said forward direction, wherein a position of the axis of rotation with reference to the bracket is fixed; and a tilting device engaged with said bracket arranged for providing tilting of a plane of rotation of said shelf during rotation of said shelf relative to said bracket between said display position and said refill position, wherein said tilting device is configured to provide tilting of the plane of rotation of the shelf during rotation so as to control the inclination angle of the shelf, and wherein a direction and an amplitude of said tilting during rotation of said shelf between said display position and said refill position, is selected to provide a set inclination angle of said shelf in said refill position.

2. The shelf unit according to claim 1, wherein said set inclination angle in the refill position is zero degrees, so as to level said shelf.

3. The shelf unit according to claim 1, wherein said inclination angle in the display position is at least partly provided by said tilting device.

4. The shelf unit according to claim 1, wherein said tilting device is arranged on said bracket, and is a rotatable inclined bracket element having a set bracket angle, wherein said tilting of said plane of rotation is determined by said bracket angle.

5. The shelf unit according to claim 1, wherein said tilting device is arranged as a rail whose vertical profile includes a height difference along an extension of the rail, and a corresponding tracking device arranged for running along said rail, said rail being arranged on said shelf, and said corresponding tracking device being arranged on said bracket, or vice versa.

6. The shelf unit according to claim 5, wherein said tracking device is at least one roller element.

7. The shelf unit according to claim 5, wherein said rail runs along at least part of a circular path.

8. The shelf unit according to claim 5, wherein said height difference of the rail is proportional to the rotation of the shelf.

9. The shelf unit according to claim 8, wherein at least a portion of said bracket is arranged to tilt during the rotation of the shelf.

10. The shelf unit according to claim 5, wherein said tracking device includes at least one roller element, and wherein said rail runs along at least part of a circular path.

11. The shelf unit according to claim 5, wherein said tracking device includes at least one roller element, and wherein said height difference of the rail is proportional to the rotation of the shelf.

12. The shelf unit according to claim 5, wherein said tracking device includes at least one roller element, wherein said height difference of the rail is proportional to the rotation of the shelf, and wherein said rail runs along at least part of a circular path.

13. The shelf unit according to claim 5, wherein said tracking device tracks the rail of the shelf, wherein two roller elements, adapted to be movably engaged with opposite sides of the rail, are arranged having a vertical separation into which the rail is fitted.

14. The shelf unit according to claim 13, wherein said vertical separation of the two roller elements is fixed or guided by a spring such that each roller element presses onto its respective side of the rail, so as to control the position of the shelf.

15. The shelf unit according to claim 1, said bracket further being arranged for mounting into an existing shelving system.

16. The shelf unit according to claim 1, wherein said shelf is arranged to rotate about an asymmetrically positioned axis of rotation, which is positioned closer to the front edge of the shelf than to the rear side of the shelf.

17. The shelf unit according to claim 1, further comprising a device for interconnecting one of said shelf units with at least one adjacently positioned one of shelf units.

18. A refrigerator comprising the shelf assembly according to claim 1.

19. A cabinet comprising the shelf assembly according to claim 1.

* * * * *